US007556366B2

(12) United States Patent
Kudo et al.

(10) Patent No.: US 7,556,366 B2
(45) Date of Patent: Jul. 7, 2009

(54) INK CARTRIDGE

(75) Inventors: Kiyomitsu Kudo, Tokyo (JP); Junji Shimoda, Kanagawa (JP); Akira Tsujimoto, Kanagawa (JP); Satoshi Kudo, Kanagawa (JP); Toru Suzuki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 273 days.

(21) Appl. No.: 11/556,559

(22) Filed: Nov. 3, 2006

(65) Prior Publication Data

US 2007/0052778 A1 Mar. 8, 2007

Related U.S. Application Data

(63) Continuation of application No. 10/832,491, filed on Apr. 26, 2004, now Pat. No. 7,192,127.

(30) Foreign Application Priority Data

Apr. 25, 2003 (JP) ..... 2003-122006
Apr. 26, 2004 (JP) ..... 2004-129776

(51) Int. Cl.
*B41J 2/175* (2006.01)

(52) U.S. Cl. ..... 347/86

(58) Field of Classification Search ..... 347/85, 347/86, 87; 141/2, 18, 330, 331, 332; 604/257
See application file for complete search history.

(56) References Cited

U.S. PATENT DOCUMENTS 2,670,871 A 3/1954 Spiess, Jr. et al.
4,210,623 A 7/1980 Breno et al.
4,976,894 A 12/1990 Robinson
5,523,780 A 6/1996 Hirosawa et al.
6,132,036 A * 10/2000 Abe et al. ..... 347/86
6,299,296 B2 10/2001 Gasvoda
6,332,676 B1 * 12/2001 Santhanam ..... 347/86
6,634,738 B1 10/2003 Shinada et al.

(Continued)

FOREIGN PATENT DOCUMENTS

JP 58-082260 5/1983

(Continued)

OTHER PUBLICATIONS

Japanese Office Action, dated Aug. 24, 2005.

*Primary Examiner*—Anh T. N. Vo
(74) *Attorney, Agent, or Firm*—Fitzpatrick, Cella, Harper & Scinto

(57) ABSTRACT

A joint member is made of an elastic member whose cross sectional shape is an almost M-character shape and which has: an inserting portion formed with an opening portion and a slit; an outer edge portion as an outer peripheral portion of the joint member; and a supporting fixing portion for coupling the inserting portion and the outer edge portion on the upper portion side. A cross sectional shape of an opening of the opening portion is a shape of a circular cone frustum in which the opening and a bottom surface are coupled via an inclined surface. The slit is formed in the rectangular bottom surface. The joint member is sandwiched between a casing and a pressing plate. The inserting portion and the supporting fixing portion exist in planes which are different in the inserting direction of a liquid supply needle.

5 Claims, 7 Drawing Sheets

U.S. PATENT DOCUMENTS

| | | | | |
|---|---|---|---|---|
| 6,692,118 | B2 * | 2/2004 | Michele et al. | 347/86 |
| 6,783,219 | B2 * | 8/2004 | Lui et al. | 347/86 |
| 6,789,885 | B1 * | 9/2004 | Michele et al. | 347/86 |

FOREIGN PATENT DOCUMENTS

| | | |
|---|---|---|
| JP | 05-345423 | 12/1993 |
| JP | 06-008463 | 1/1994 |
| JP | 07-017049 | 1/1995 |
| JP | 09-076525 | 3/1997 |
| JP | 2000-043288 | 2/2000 |
| JP | 2000-334982 | 12/2000 |
| JP | 2002-307713 | 10/2002 |
| JP | 2002-307722 | 10/2002 |
| JP | 2003-200594 | 7/2003 |
| JP | 2003-246077 | 9/2003 |

* cited by examiner

FIG. 5A1
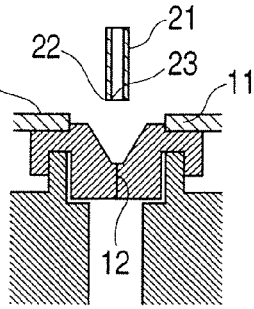
FIG. 5A2
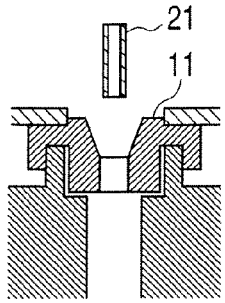
FIG. 5B1
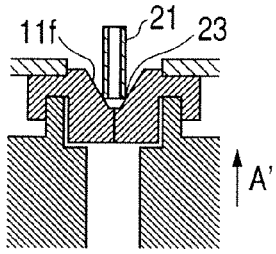
FIG. 5B2
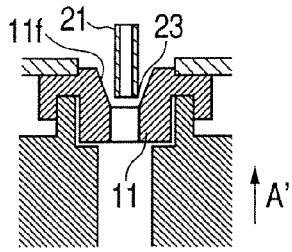
FIG. 5C1
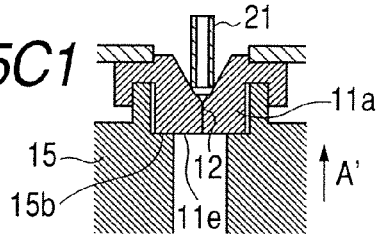
FIG. 5C2
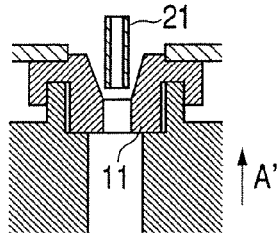
FIG. 5D1
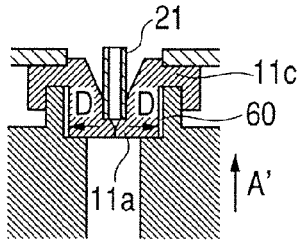
FIG. 5D2
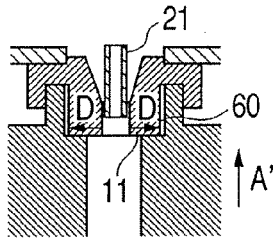
FIG. 5E1
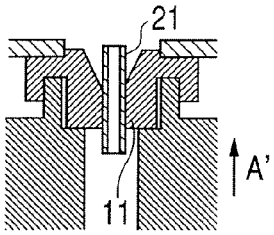
FIG. 5E2
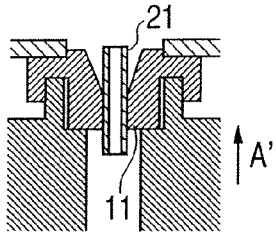

INK CARTRIDGE

RELATED APPLICATION

This is a continuation of co-pending U.S. application Ser. No. 10/832,491, filed Apr. 26, 2004, which is incorporated herein in its entirety.

BACKGROUND OF THE INVENTION

1. Field of the Invention

The invention relates to an ink cartridge and, more particularly, to an ink cartridge having an improved joint portion.

2. Related Background Art

An ink cartridge of an exchange type which is mounted in an ink jet recording apparatus is mainly classified into the following two types.

According to one type, a fiber member such as a sponge or the like is arranged into a liquid supply port of the ink cartridge, leakage of ink is prevented by the fiber member, and liquid is supplied to a liquid discharge head in a state where the fiber member is come into pressure contact with a liquid introducing port communicating with the liquid discharge head.

According to the other type, a joint member having a slit is arranged in the ink cartridge and the liquid is supplied by inserting a liquid supply needle communicating with the liquid discharge head into the slit.

As a liquid supplying method of the ink jet recording apparatus using the ink cartridge having the joint member according to the latter type, there can be mentioned: a tube supplying method whereby the liquid supply needle is inserted into the slit and in such a state, the liquid is supplied from a liquid enclosing portion to the liquid discharge head via a tube communicating with the liquid supply needle; and an intermittent ink supplying method whereby the liquid supply needle is inserted into the slit each time the ink is supplied, so that the liquid is supplied (hereinafter, an expression "pit-in" is used for convenience of explanation); or the like.

The joint member which is used in the pit-in supplying method is ordinarily fitted into a casing and fixed. A pressure is applied in the clamping direction of the slit by the fitting. As a joint member with such a construction, for example, there has been disclosed a construction in which a slit is formed in a flat elastic member (rubber) and the slit itself is widened by making a projection come into contact with the slit portion, thereby releasing the air for the ink supply.

However, according to the tube supplying method and the pit-in supplying method mentioned above, a problem can occur such that the ink leaks from the joint member.

In the case of the tube supplying method, although the joint member and the liquid supply needle of the ink cartridge are kept connected, there is a case where the clamping pressure applied to the liquid supply needle from the joint member is decreased by creep deformation of the joint member and the ink leaks. There is also a case where when the liquid supply needle is inserted, the joint member is damaged and the ink leaks from a damaged portion.

In the pit-in supplying method, although the number of joining times differs in dependence on a capacity of the ink enclosing portion and that of the sub-tank of the ink jet recording head, since the joining operation is executed about tens to 100 times, there is a case where the joint member deteriorates and the ink leaks.

To prevent the occurrence of such leakage, it is necessary to determine a rubber material, a thickness of rubber, a shape of the projection, a shape of the slit, and the like. An inserting force is necessary when the slit in the elastic member is opened by inserting the projection into the slit so as to be come into contact therewith. When the rubber thickness or the like increases, while the reliability against the ink leakage is generally improved, there is a tendency of an increase in inserting force and it can burden a driving system of the main body.

SUMMARY OF THE INVENTION

It is, therefore, an object of the invention to provide an ink cartridge which can prevent occurrence of ink leakage and reduce an inserting force of a liquid supply needle upon joining.

To accomplish the above object, according to the invention, there is provided an ink cartridge which has joint members each comprising an elastic member formed with a slit into/from which a liquid supply needle communicating with a liquid tank in a liquid discharge head is inserted/pulled out and which encloses liquid in a casing, wherein a concave portion which guides the liquid supply needle into the slit is formed in the joint member and the joint member has a portion in which a projection shape of an opening portion of the concave portion seen in the inserting/pulling-out direction of the liquid supply needle into/from the slit is larger than a needle projection shape as a projection shape of an exterior of the liquid supply needle seen in the inserting/pulling-out direction and a projection shape of a bottom portion of the concave portion is smaller than the needle projection shape.

The ink cartridge of the invention mentioned above has the joint member in which the concave portion having the portion whose opening portion is larger than the external shape of the liquid supply needle and whose bottom portion is smaller than the external shape of the liquid supply needle is formed, that is, the concave portion in a narrow shape for guiding the liquid supply needle into the slit is formed. That is, the concave portion in which an outer diameter portion of the liquid supply needle is certainly come into contact with an inclined surface before the liquid supply needle is inserted into the slit is formed in the joint member.

Since the ink cartridge of the invention has the concave portion in such a shape, first, a positional deviation of the liquid supply needle to the slit is corrected by the concave portion of the opening larger than the outer diameter of the liquid supply needle and the liquid supply needle enters into the concave portion, subsequently, the needle moves toward the slit while being guided along the inclined surface of the concave portion in the narrow shape from the opening toward the bottom portion and further enters the slit, so that the liquid supply needle is inserted into the slit while gradually pressing and widening the slit in the outer diameter portion of the needle. Consequently, the joint member can insert the liquid supply needle into the slit without being come into contact with the liquid supply needle at the surface which almost perpendicularly crosses the inserting direction of the liquid supply needle.

According to the ink cartridge of the invention, the joint member can be also fixed by a sandwiching force in the direction which is almost parallel with the penetrating direction of the slit which penetrates the joint member. In this case, a pressure which is generated when the joint member is sandwiched is not applied in the clamping direction of the slit.

According to the ink cartridge of the invention, when a length of slit in the longitudinal direction lies within a range from 0.3 mm or more to 0.8 mm or less, a thickness of joint member may lie within a range from 0.3 mm or more to 1.0 mm or less.

BRIEF DESCRIPTION OF THE DRAWINGS

FIGS. 5A1, 5B1, 5C1, 5D1, 5E1, 5A2, 5B2, 5C2, 5D2 and 5E2 are diagrams for explaining a step of inserting the liquid supply needle into a slit of the joint member;

DETAILED DESCRIPTION OF THE PREFERRED EMBODIMENTS

Embodiments of the invention will now be described with reference to the drawings.

First Embodiment

Figure 1:
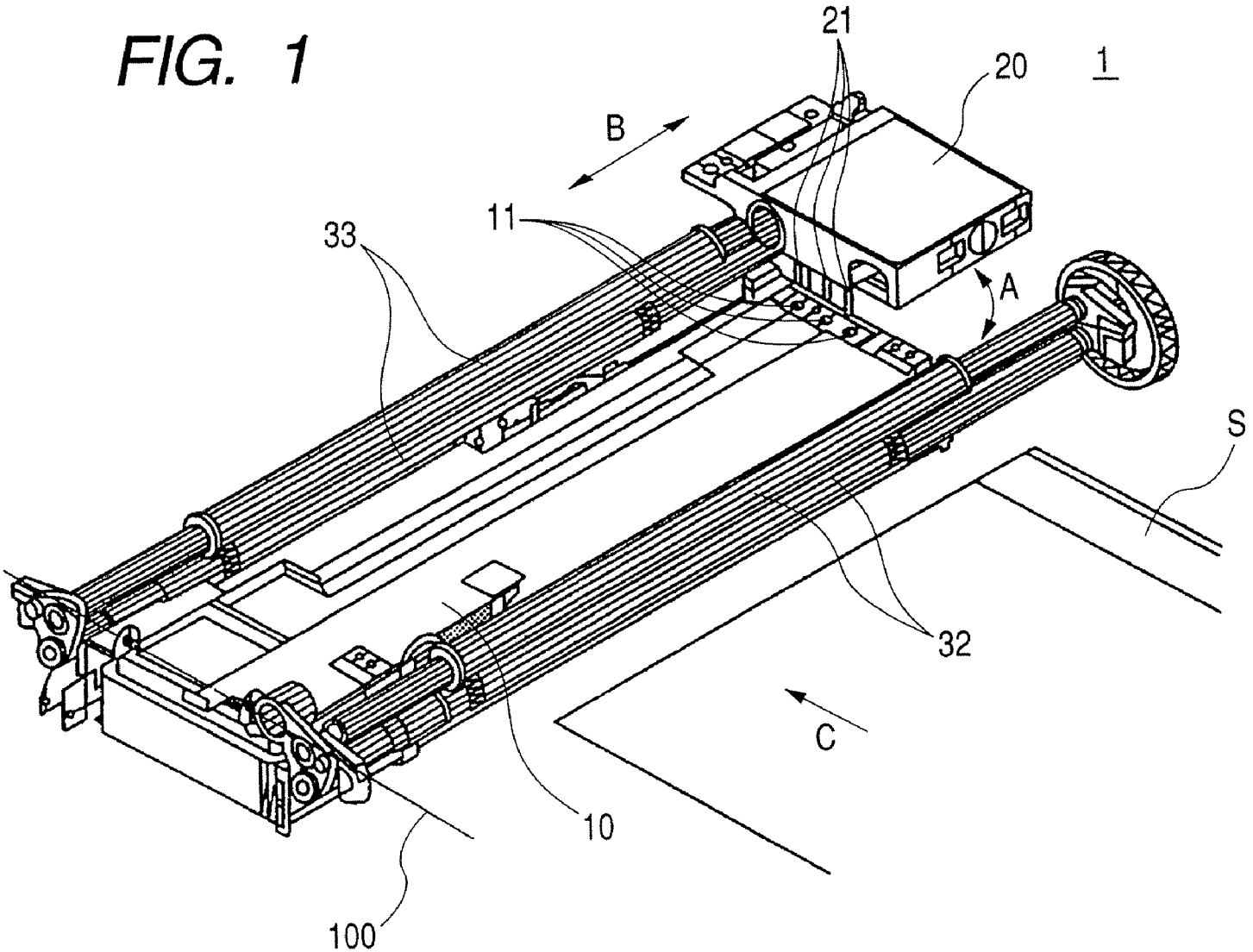
FIG. 1 is a schematic perspective view of an ink jet recording apparatus in the first embodiment of the invention.
Figure 2:
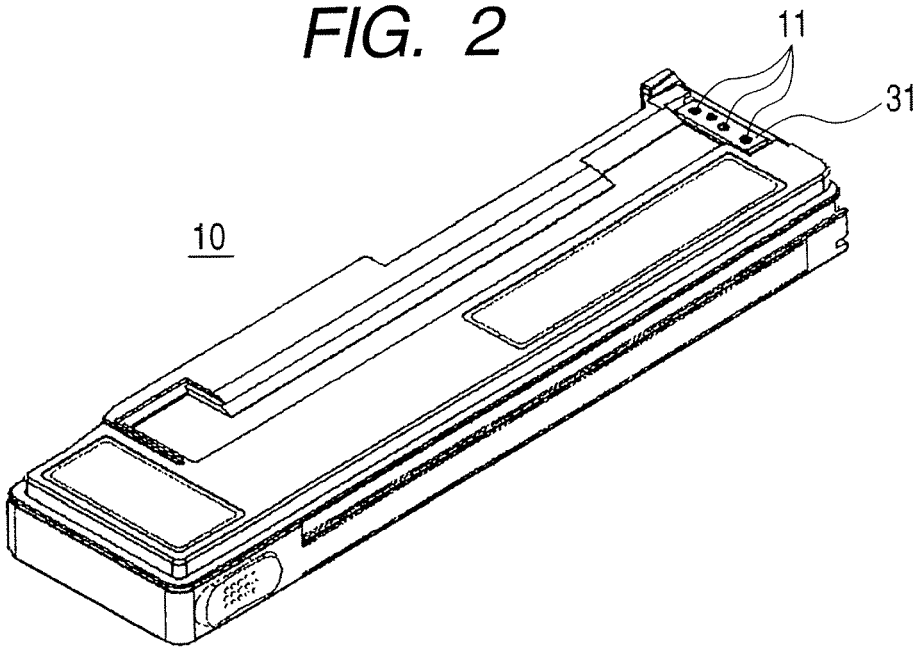
FIG. 2 is a schematic perspective view of an ink cartridge in the first embodiment of the invention.
Figure 3:
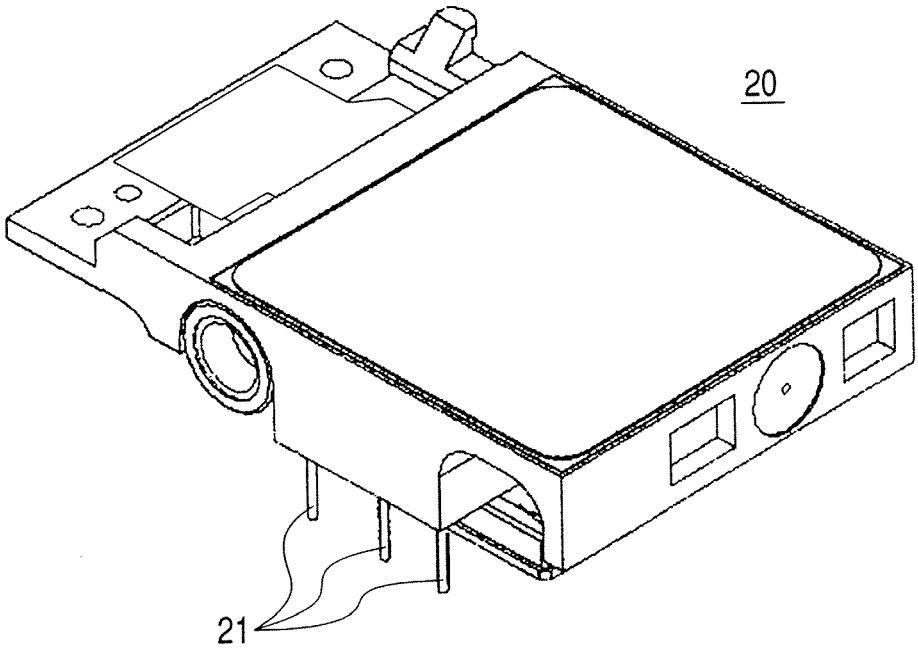
FIG. 3 is a schematic perspective view of a liquid discharge head in the first embodiment of the invention.

FIG. 1 is a schematic perspective view of an ink jet recording apparatus according to the embodiment. FIG. 2 is a schematic perspective view of an ink cartridge in the embodiment. FIG. 3 is a schematic perspective view of a liquid discharge head in the embodiment.

The ink jet recording apparatus shown in FIG. 1 is a recording apparatus of a serial type in which while a reciprocating movement (main scan) of a liquid discharge head 20 and a conveyance (sub-scan) at every predetermined pitch of a recording sheet S are repeated, ink is selectively discharged from the liquid discharge head 20 (refer to FIG. 3) synchronously with those motions and deposited onto the recording sheet S, thereby forming characters, symbols, an image, or the like. The liquid discharge head 20 is slidably supported by two guide rails (not shown) and reciprocation-scanned along the guide rails by driving means such as a motor or the like (not shown). The recording sheet S is conveyed by a conveying roller 32 in the direction which crosses the moving direction of the liquid discharge head 20 (for example, the direction shown by an arrow C as a direction which perpendicularly crosses the moving direction) so as to face an ink discharge surface of the liquid discharge head 20 and maintain a distance from the ink discharge surface to a predetermined distance. The recording sheet S recorded by the ink discharged from the liquid discharge head 20 is ejected to the outside of the apparatus by a paper ejecting roller 33.

An ink cartridge 10 of the embodiment encloses three ink bags (not shown) for enclosing ink of three colors of Y (yellow), M (magenta), and C (cyan), respectively. Each ink bag communicates with a joint member 11.

The liquid discharge head 20 has a liquid discharge unit (not shown) for discharging liquid and an ink tank (not shown) for enclosing the ink to be supplied to the liquid discharge unit. The ink tank is divided into three chambers for enclosing the ink of Y, M, and C, respectively. The chambers communicate with three liquid supply needles 21 extending downwardly from the lower surface side of the liquid discharge head 20, respectively.

The ink jet recording apparatus of the embodiment has a driving source (not shown) for rotating the ink cartridge 10 around a rotary shaft 100. The portion of the ink cartridge 10 on the side of the joint members 11 can be elevated up/down in almost the vertical directions (directions shown by an arrow A in FIG. 1) by the rotation of the ink cartridge.

An ink supplying method in the embodiment will now be described. The ink supplying method in the ink jet recording apparatus of the embodiment is what is called a pit-in supplying method.

At the time of the recording operation, the portion of the ink cartridge 10 on the side of the joint members 11 has been descended so that the liquid supply needles 21 of the liquid discharge head 20 which is reciprocation-scanned in the directions shown by an arrow B and the ink cartridge 10 do not interfere with each other.

When a residual amount of the ink in the ink tank in the liquid discharge head 20 decreases to a predetermined amount or less by discharging the ink and recording, the liquid discharge head 20 is returned to a home position (position in FIG. 1).

When the liquid discharge head 20 in which the ink residual amount becomes equal to or less than the predetermined amount is returned to the home position, the ink supplying operation to supply the ink enclosed in the ink bags in the ink cartridge 10 to the liquid discharge head 20 is started. That is, the driving source rotates the ink cartridge 10 around the rotary shaft 100, so that the liquid supply needles 21 are inserted into slits 12, which will be explained hereinafter, of the joint members 11, respectively.

Subsequently, a suction pump (not shown) is coupled with a part of the liquid discharge head 20 and reduces a pressure in the ink tank. By the pressure reduction, the ink in the ink bag of the ink cartridge 10 is supplied into the ink tank in the liquid discharge head 20. A full-tank valve is arranged in the ink tank of the liquid discharge head 20. When the ink tank is full, the ink is not supplied any more.

The number of pit-in supplying times differs depending on a recording duty, a capacity of the ink bag, and a capacity of the ink tank. In the ink jet recording apparatus according to the embodiment, the pit-in operation is executed about 30 times on the assumption that the capacity of the ink bag of each color is set to 4.2 ml, the capacity of the ink tank of each color is set to 0.45 ml, the recording duty is set to 25%, and the pit-in supply is executed each time one recording sheet is recorded.

A structure of the joint member 11 of the ink cartridge 10 in the embodiment and a relation between the joint member 11 and the liquid supply needle 21 of the liquid discharge head 20 will now be described.

Figure 4A:
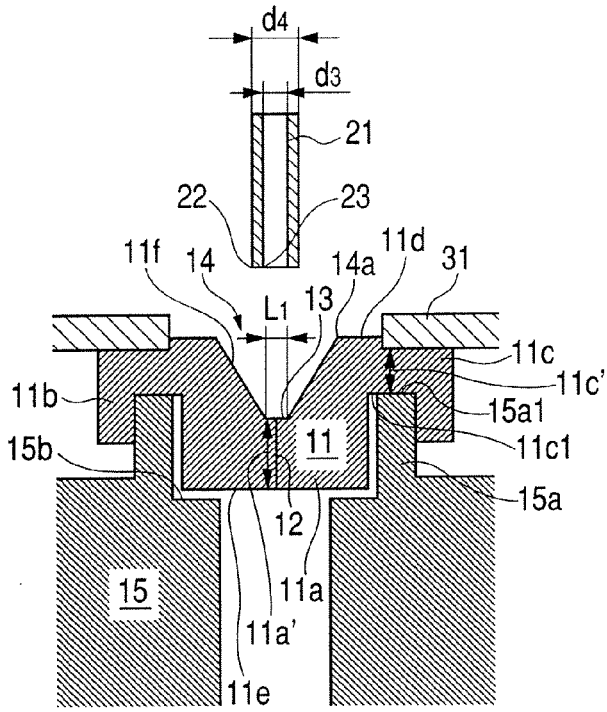
FIGS. 4A, 4B, 4C and 4D are diagrams for explaining a relation between a joint member and a liquid supply needle in the first embodiment of the invention.
Figure 4B:
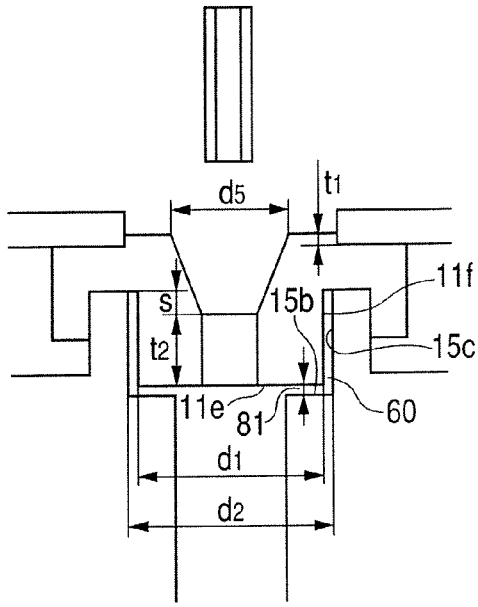
Figure 4C:
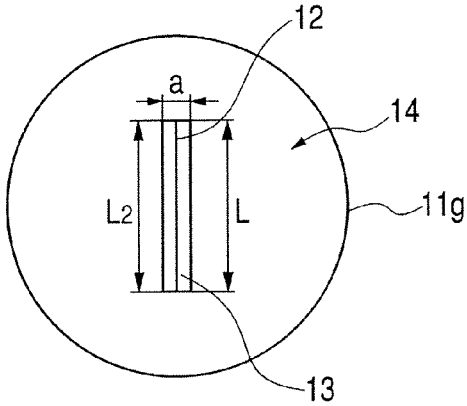
Figure 4D:
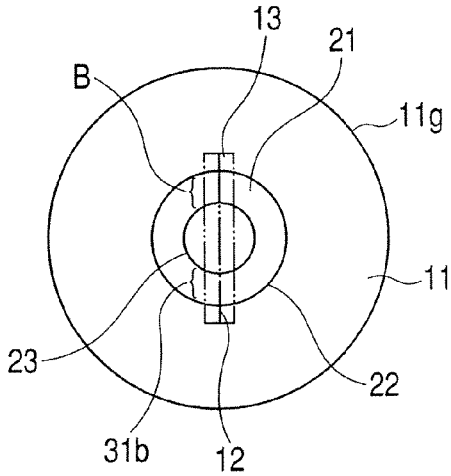

FIGS. 4A to 4D are diagrams for explaining the relation between the joint member and the liquid supply needle in the embodiment. FIG. 4A is a schematic cross sectional view. FIG. 4B is a schematic cross sectional view obtained by rotating FIG. 4A by 90°. FIG. 4C is a schematic top view of the joint member. FIG. 4D is a schematic top view of the joint member and the liquid supply needle. In FIG. 4B, a hatching illustration of a cross section of each portion is omitted.

The liquid supply needle 21 of the liquid discharge head 20 is made of a material SUS304 and is in a pipe shape in which an outer diameter d4 is equal to ϕ0.5 mm and an inner diameter d3 is equal to ϕ0.3 mm. Although a state of the surface of the liquid supply needle 21 differs in dependence on conditions such as barrel process, chemical polishing, and the like, the needle 21 is in a shape having an outer diameter edge 22 and an inner diameter edge 23.

The joint member 11 comprises an elastic member whose cross sectional shape is an almost M-character shape and which has: an inserting portion (that is, a portion into which a liquid supply needle is inserted) 11*a* formed with an opening portion 14 and the slit 12; an outer edge portion 11*b* serving as an outer peripheral portion of the joint member 11; and a supporting fixing portion 11*c* for coupling the inserting portion 11*a* and the outer edge portion 11*b* on the upper portion side. Since it is desirable to use an elastic rubber member which can be easily deformed as a material of the joint member 11, a chlorinated butyl rubber is used in the embodiment.

The slit 12 is a slit-shaped through hole notched from the opening portion 14 side to the lower surface side of the inserting portion 11*a*. In a state where the liquid supply needle 21 is not inserted, the slit 12 is in a state where it is closed by its own inner stress.

The opening portion 14 formed in the inserting portion 11*a* is formed as a concave portion in a shape of a frustum of a circular cone in which an opening 14*a* on an upper surface 11*d* side is circular, it is narrowed downwardly from the upper surface 11*d* side, a bottom surface 13 is a rectangular shape, a cross sectional shape is as shown in FIGS. 4A and 4B, and the opening 14*a* and the bottom surface 13 are coupled by an inclined surface 11*f*. The bottom surface 13 has a rectangular shape in which the direction along which the slit 12 is formed is set to the longitudinal direction.

Those portions have the following dimensions. A diameter d5 of the opening 14*a* of the opening portion 14 is equal to ϕ1.4 mm, a width L1×a length L2 of the bottom surface 13 are equal to 0.2 mm×0.7 mm, and a length L of the slit 12 is equal to 0.7 mm, which is the same as the length L2 of the bottom surface 13. As mentioned above, the opening portion 14 has the concave shape of the circular cone in which the diameter d5 of the opening 14*a* of the opening portion 14 is larger than the outer diameter d4 of the liquid supply needle 21, the width L1 of the bottom surface 13 is smaller than the outer diameter d4 of the liquid supply needle 21, and the opening 14*a* and the bottom surface 13 are coupled via the inclined surface 11*f*. When the liquid supply needle 21 and the joint member 11 are seen from the top surface, as shown in FIG. 4D, the joint member 11 has crossing portions 13*b* in which the outer diameter of the liquid supply needle 21 and the projection shape of the bottom surface 13 of the joint member 11 cross.

The joint member 11 is put onto an upper surface 15*a*1 of a supporting portion 15*a* provided for the casing 15 so that a lower surface 11*c*1 of the supporting fixing portion 11*c* is come into contact with the upper surface 15*a*1. Further, the joint member 11 is sandwiched between the casing 15 and a pressing plate 31 so as to be crushed by a crush amount t1 by applying a pressure by the pressing plate 31 from the upper surface lid side of the supporting fixing portion 11*c*. An outer diameter dl of the inserting portion 11*a* is smaller than an inner diameter d2 of the supporting portion 15*a* of the casing 15. Consequently, a gap 60 in which even if the inserting portion 11*a* is deformed and expanded in the outer peripheral direction by inserting the liquid supply needle 21 into the slit 12, the inserting portion 11*a* is not come into contact with the supporting portion 15*a* is formed. In other words, such a situation that since the inserting portion 11*a* is pressed to the supporting portion 15*a*, it receives a reaction from the supporting portion 15*a* and a force which pushes and widens the slit 12 increases is avoided.

Although a gap 81 is also formed between a lower surface lie of the inserting portion 11*a* and a bottom surface 15*b* of the casing 15, when the liquid supply needle 21 is inserted into the slit 12, the lower surface l1*e* of the inserting portion 11*a* is come into contact with the bottom surface 15*b* of the casing 15 and the inserting portion 11*a* is supported.

A portion 11*a*' of the inserting portion 11*a* of the joint member 11 and a portion 11*c*' of the supporting fixing portion 11*c* do not exist in the same plane in the inserting direction of the liquid supply needle 21. In other words, the bottom surface 13 of the portion 11*a*' formed with the slit 12 and the lower surface 11*c*1 of the supporting fixing portion l1*c* are arranged so as to be away from each other at a distance s (refer to FIG. 4B). Further, the direction of a force which sandwiches the portion 11*c*' of the supporting fixing portion 11*c* is set to be almost the same as the direction in which the liquid supply needle 21 is inserted into the slit 12. Owing to such a construction, the inner stress which is generated by sandwiching the portion 11*c*' of the supporting fixing portion 11*c* is not applied in the clamping direction (direction shown by arrows "a" in FIG. 4C) of the slit 12. Therefore, the inserting force to insert the liquid supply needle 21 becomes only the force to push and widen the slit 12 of the joint member 11. The inserting force is extremely smaller than the pressure which is applied in the clamping direction of the slit by fitting the joint member into an ordinary casing, so that a load on the driving system of the main body can be reduced.

A step in which the liquid supply needle is inserted into the slit of the joint member will now be described.

FIGS. 5A1 to 5E1 and 5A2 to 5E2 are diagrams for explaining the step in which the liquid supply needle is inserted into the slit of the joint member according to the embodiment. FIGS. 5A1 to 5E1 are schematic cross sectional views corresponding to the diagram shown in FIG. 4A. FIGS. 5A2 to 5E2 are schematic cross sectional views corresponding to the diagram shown in FIG. 4B.

FIGS. 5A1 and 5A2 show a state where the liquid supply needle 21 is located right over the joint member 11. When an instruction (flag) to perform the pit-in supply is set to the high level, the liquid discharge head 20 is returned to the home position and enters the state shown in the diagrams.

From this state, the ink cartridge 10 starts to rotate by the driving source of the ink jet recording apparatus. The joint member 11 moves in the direction shown by an arrow A' in the diagrams. The liquid supply needle 21 enters the opening portion 14. The outer diameter edge 22 of the liquid supply needle 21 is obliquely come into contact with the inclined surface 11*f* of the joint member 11 as shown in FIG. 5B1. At this time, in the cross sectional view of FIG. 5B2, there is no portion in which the liquid supply needle 21 and the joint member 11 are come into contact with each other. Even if a positional deviation between the liquid supply needle 21 and the joint member 11 occurs upon entering, an error of the positional deviation can be absorbed by an amount corresponding to a difference between the diameter d5 of the opening 14*a* and the outer diameter d4 of the liquid supply needle 21.

When the movement of the joint member 11 in the direction shown by the arrow A' progresses, the outer diameter edge 22 of the liquid supply needle 21 slides on the inclined surface 11*f*, is guided to the slit 12, and gradually opens the slit 12 by the inserting force of the liquid supply needle 21 (FIGS. 5C1 and 5C2). Since the liquid supply needle 21 starts to open the slit 12 while pushing the joint member 11 downwardly, the joint member 11 made of the elastic member is widened in the direction opposite to the direction shown by the arrow A'. The lower surface 11*e* of the inserting portion 11*a* is come into contact with the bottom surface 15*b* of the casing 15 and the joint member 11 enters a state where the inserting portion 11*a* is supported.

When the movement of the joint member 11 in the direction shown by the arrow A' further progresses, the liquid supply needle 21 is gradually inserted into the slit 12 while pushing and widening the slit 12 in the directions shown by the arrows D (FIGS. 5D1 and 5D2). That is, since the liquid supply needle 21 is inserted into the slit 12 while pushing and widening the slit 12, the outer diameter edge 22 and the inner diameter edge 23 of the liquid supply needle 21 are not come into contact with the joint member 11 at almost the right angle. Consequently, the occurrence of scraping, cracks, or the like of the joint member which is caused from the outer diameter edge 22 and the inner diameter edge 23 as start points can be prevented.

As mentioned above, the joint member 11 of the embodiment has the shape in which the bottom surface 13 of the inserting portion 11*a* and the lower surface 11*c*1 of the supporting fixing portion l1*c* are away from each other at the distance s. In the relation between the joint member 11 and the casing 15 of the ink cartridge 10, the direction of the force to sandwich the portion 11*c*' of the supporting fixing portion 11*c* and the inserting direction of the liquid supply needle 21 into the slit 12 are set to almost the same direction. Further, the gap 60 is formed between the inserting portion 11*a* and the supporting portion 15*a*. Therefore, the inserting force which is necessary when the liquid supply needle 21 is inserted into the slit 12 becomes only the force to push and widen the slit 12 of the joint member 11.

When the movement of the joint member 11 in the direction shown by the arrow A' further progresses, the liquid supply needle 21 penetrates the joint member 11 and the joining operation is completed (FIGS. 5E1 and 5E2). In this state, the ink in the ink bag of the ink cartridge is supplied into the ink tank of the liquid discharge head. In the case of the embodiment, since the pressure which is generated by sandwiching the joint member 11 is not applied in the clamping direction to the slit 12, ink leakage which is caused since the inserting portion 11*a* is deformed by such a pressure and a small opening portion is formed in the slit 12 does not occur.

As described above, according to the embodiment, when the liquid supply needle 21 is inserted into the slit 12, even if the positional deviation between the liquid supply needle 21 and the joint member 11 occurs, the error of the positional deviation is absorbed by the amount corresponding to the difference between the diameter d5 of the opening 14*a* and the outer diameter d4 of the liquid supply needle 21. The outer diameter edge 22 of the liquid supply needle 21 which entered the opening portion 14 can be guided to the slit 12 along the inclined surface 11*f*. Thus, since a slight deviation of positional precision upon positioning of the liquid supply needle 21 and the slit 12 is permitted, a construction which enables the positioning of high precision becomes unnecessary. Consequently, a manufacturing method is also simplified.

According to the embodiment, since the liquid supply needle 21 is inserted into the slit 12 while pushing and widening the slit 12, the scraping, cracks, or the like of the joint member 11 which is caused when the outer diameter edge 22 and the inner diameter edge 23 of the liquid supply needle 21 are come into contact with the joint member 11 at almost the right angle does not occur. Thus, the occurrence of the ink leakage from the joint member 11 can be prevented and the reliability of the joining operation can be fairly improved.

Further, the joint member 11 of the embodiment is constructed in such a manner that the inserting portion 11*a* and the supporting fixing portion 11*c* do not exist in the same plane, the direction of the force to sandwich the supporting fixing portion 11*c* and the inserting direction of the liquid supply needle 21 are set to almost the same direction, and further, the inserting portion 11*a* is not come into contact with the supporting portion 15*a*. Therefore, the inserting force which is necessary when the liquid supply needle 21 is inserted into the slit 12 becomes only the force to push and widen the slit 12 of the joint member 11. Consequently, in the case of the embodiment, the necessary inserting force is extremely smaller than the inserting force for inserting the liquid supply needle into the joint member which applies the pressure in the clamping direction of the slit by fitting the joint member into the casing. Since the load on the driving system of the main body is reduced, the apparatus can be miniaturized. Since the pressure which is generated by sandwiching the joint member 11 is not applied in the clamping direction to the slit 12, even in a state where the liquid supply needle 21 penetrates the joint member 11, a situation that the small opening portion is formed in the slit 12 due to the deformation of the inserting portion 11*a* and the ink leakage is caused does not occur.

Second Embodiment

Figure 6A:
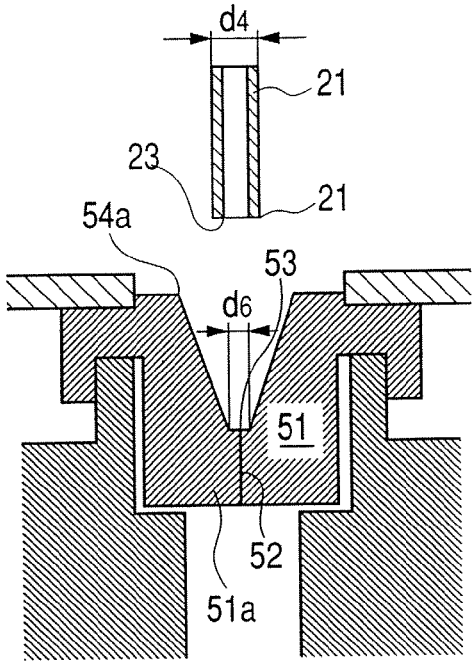
FIGS. 6A, 6B, 6C and 6D are diagrams for explaining a relation between a joint member and a liquid supply needle in the second embodiment of the invention.
Figure 6B:
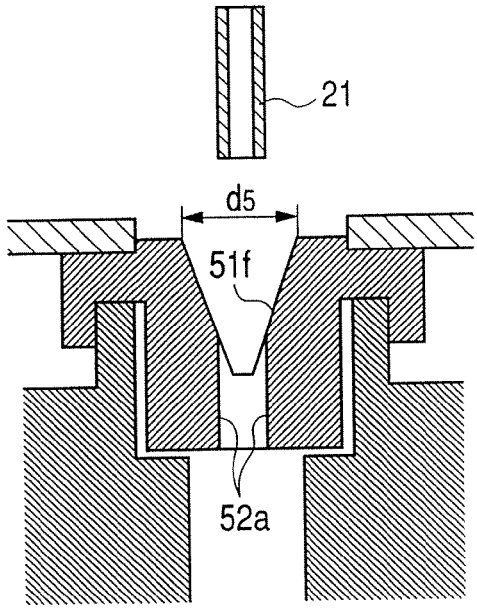
Figure 6C:
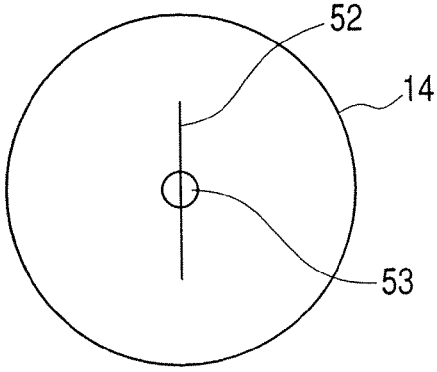
Figure 6D:
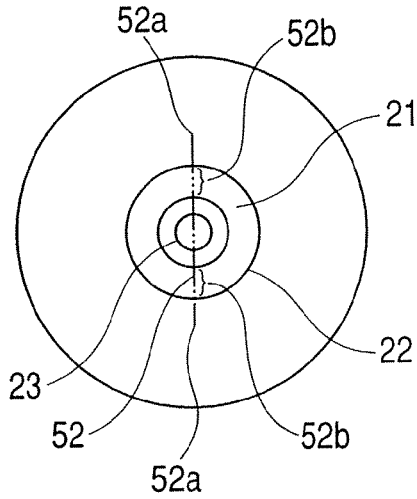

FIGS. 6A to 6D are diagrams for explaining a relation between the joint member and the liquid supply needle in the second embodiment. FIG. 6A is a schematic cross sectional view. FIG. 6B is a schematic cross sectional view obtained by rotating FIG. 6A by 90°. FIG. 6C is a schematic top view of the joint member. FIG. 6D is a schematic top view of the joint member and the liquid supply needle.

The second embodiment will be described with respect to points different from the first embodiment and an explanation regarding points similar to those in the first embodiment is omitted. In the second embodiment, the same component elements as those in the first embodiment are designated by the same reference numerals and will be explained by using the same reference numerals.

In a joint member 51 in the second embodiment, a bottom surface 53 has a circular shape and its diameter d6 is smaller than the outer diameter d4 of the liquid supply needle 21. Since the joint member 51 has such a bottom surface 53, edge portions 52*a* are located on an inclined surface 51*f* because a slit 52 is notched from the inclined surface 51*f*. Those portions of the joint member 51 in the second embodiment have the following dimensions. The diameter d5 of an opening 54*a* is equal to ϕ1.4 mm, the diameter d6 of the bottom surface 53 is equal to ϕ0.2 mm, and the length L of the slit 52 is equal to 0.7 mm.

The joint member 51 in the second embodiment is similar to the joint member 11 in the first embodiment except that the shape of the bottom surface 53 differs as mentioned above.

According to the second embodiment, therefore, in a manner similar to the first embodiment, the construction which enables the positioning of high precision when the liquid supply needle 21 is inserted into the slit 52 becomes unnecessary. Consequently, a manufacturing method is also simplified. Since the scraping or cracks of the joint member 51 which are caused due to the outer diameter edge 22 and the inner diameter edge 23 of the liquid supply needle 21 are difficult to occur, the occurrence of the ink leakage from the joint member 51 can be prevented and the reliability of the joining operation can be extremely improved. The inserting force which is necessary when the liquid supply needle 21 is inserted into the slit 52 becomes only the force to push and widen the slit 52 of the joint member 51. Since the load on the driving system of the main body is reduced, the apparatus can be miniaturized. Even in a state where the liquid supply needle 21 penetrates the joint member 51, a situation that a small opening portion is formed in the slit 52 due to the deformation of an inserting portion 51*a* and the ink leakage is caused does not occur.

Third Embodiment

Figure 7A:
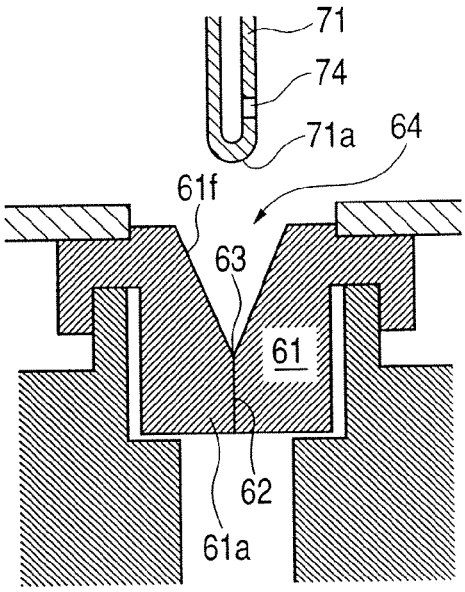
FIGS. 7A, 7B, 7C and 7D are diagrams for explaining a relation between a joint member and a liquid supply needle in the third embodiment of the invention.
Figure 7B:
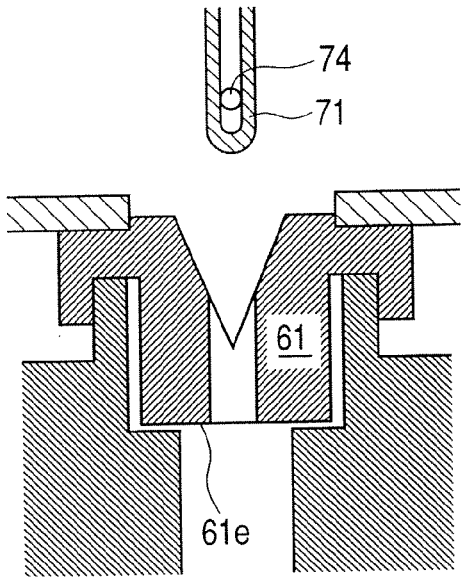
Figure 7C:
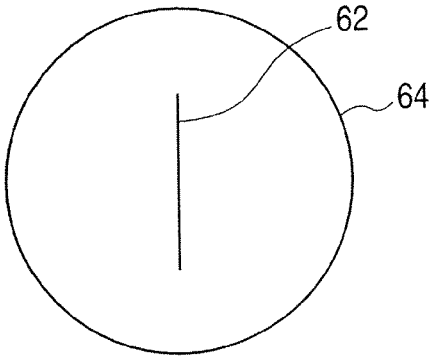
Figure 7D:
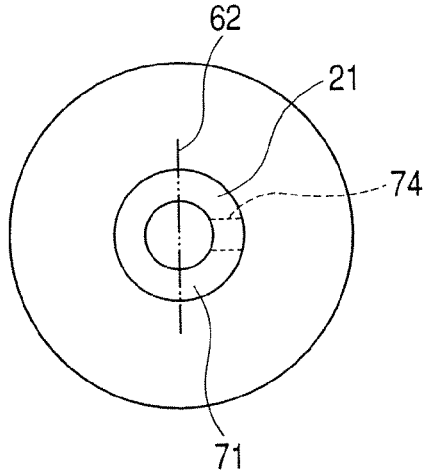

FIGS. 7A to 7D are diagrams for explaining a relation between the joint member and the liquid supply needle in the third embodiment. FIG. 7A is a schematic cross sectional view. FIG. 7B is a schematic cross sectional view obtained by rotating FIG. 7A by 90°. FIG. 7C is a schematic top view of the joint member. FIG. 7D is a schematic top view of the joint member and the liquid supply needle.

The third embodiment will be also described with respect to points different from the first embodiment and an explanation regarding points similar to those in the first embodiment is omitted in a manner similar to the second embodiment. In the third embodiment, the same component elements as those in the first embodiment are designated by the same reference numerals and will be explained by using the same reference numerals.

A liquid supply needle 71 is made of the material SUS304 and is in a pipe shape in which an outer diameter is equal to ϕ0.5 mm and an inner diameter is equal to ϕ0.3 mm. A front tip 71*a* has a spherical shape. One lateral hole opening portion 74 of ϕ0.2 mm is formed in an outer peripheral surface.

A joint member 61 is formed with an opening portion 64 whose cross sectional shape is a circular cone shape and which does not have a flat portion corresponding to the bottom surface 13 of the joint member 11 in the first embodiment or the bottom surface 53 in the second embodiment. A slit 62 is formed in the joint member 61 so as to traverse a bottom point 63 serving as an apex of the opening portion 64.

The third embodiment is similar to the first embodiment except that the front tip shape of the liquid supply needle 71 and the cross sectional shape of the joint member 61 differ from those of the first embodiment.

In the case of the third embodiment, since the liquid supply needle 71 has the edgeless spherical front tip 71*a*, when the liquid supply needle 71 is inserted into the slit 62 while pushing and widening the slit 62 or when the front tip 71*a* of the liquid supply needle 71 slides on an inclined surface 61*f* of the opening portion 64 and is guided to the slit 62, the scraping, cracks, or the like of the joint member 61 is more difficult to occur.

After the liquid supply needle 71 is inserted to a position where the lateral hole opening portion 74 pierces the joint member 61 and is exposed from a lower surface 61*e*, the ink in the ink bag of the ink cartridge is supplied into the ink tank of the liquid discharge head.

According to the third embodiment as mentioned above, in a manner similar to the first and second embodiments, the construction which enables the positioning of high precision when the liquid supply needle 71 is inserted into the slit 62 is unnecessary. Consequently, a manufacturing method is also simplified. Since the liquid supply needle 71 has the spherical front tip 71*a*, the scraping or cracks of the joint member 61 is not easily caused. Therefore, the occurrence of the ink leakage from the joint member 61 can be prevented and the reliability of the joining operation can be extremely improved. The inserting force which is necessary when the liquid supply needle 71 is inserted into the slit 62 becomes only the force to push and widen the slit 62 of the joint member 61. Since the load on the driving system of the main body is reduced, the apparatus can be miniaturized. Even in a state where the liquid supply needle 71 penetrates the joint member 61, a situation that a small opening portion is formed in the slit 52 due to the deformation of an inserting portion 61*a* and the ink leakage is caused does not occur.

Fourth Embodiment

Figure 8:
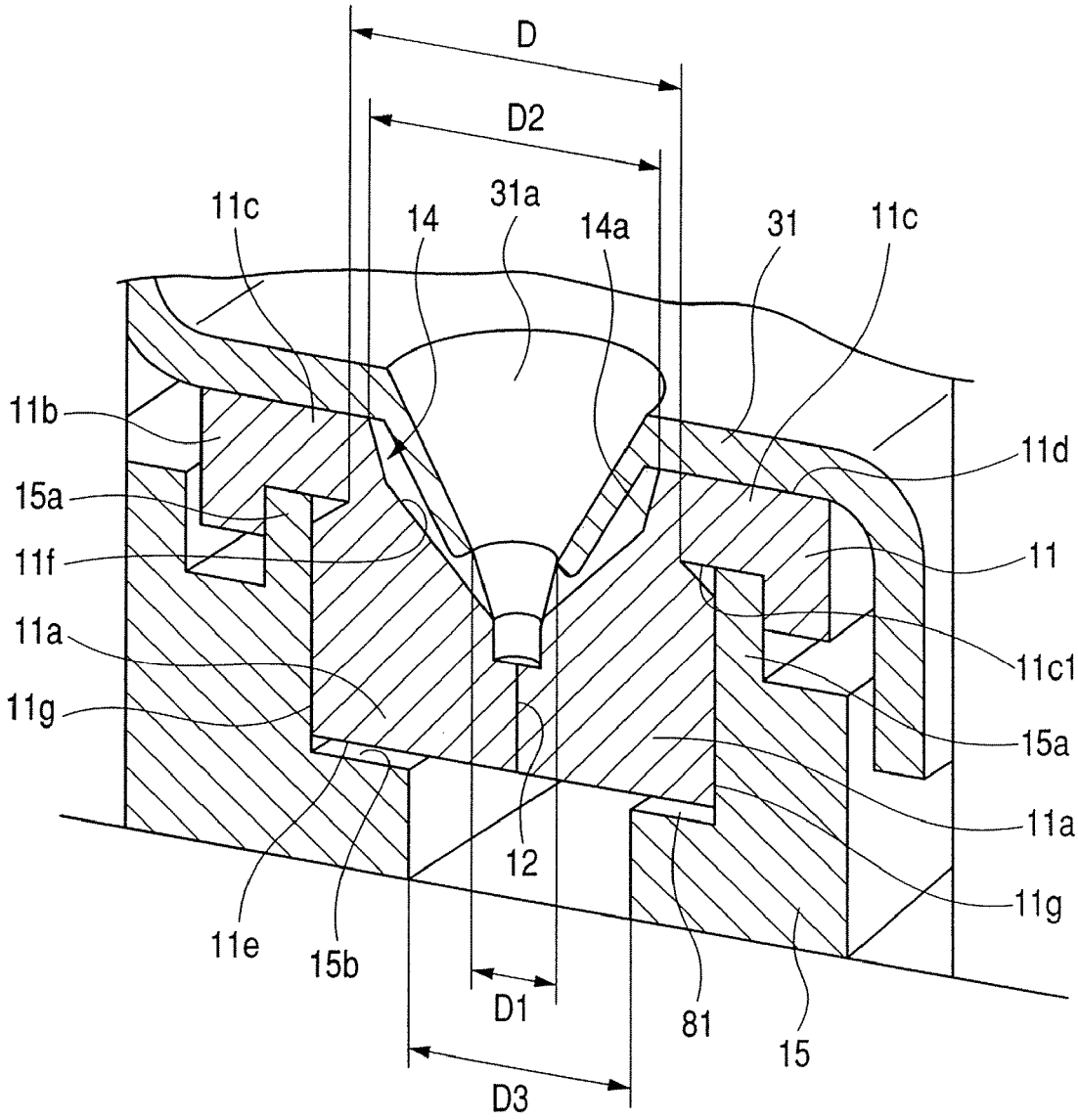
FIG. 8 is a schematic perspective view showing a joint portion in the fourth embodiment of the invention.

FIG. 8 is a schematic perspective view in the fourth embodiment showing a joint portion to which the invention is applied. The joint portion is constructed by: the elastic member 11; the housing 15 having an opening adapted to receive the elastic member 11; and the attaching plate 31 for pushing and attaching the elastic member to the housing.

The elastic member 11 comprises an elastic member whose cross sectional shape is an almost M-character shape and which has: the inserting portion 11*a* formed with the opening portion 14 and the slit 12; the outer edge portion 11*b* serving as an outer peripheral portion of the joint member 11; and the supporting fixing portion 11*c* for coupling the inserting portion 11*a* and the outer edge portion 11*b* on the upper portion side. A chlorinated butyl rubber is used in the embodiment.

The slit 12 is a slit-shaped through hole notched from the opening portion 14 side to the lower surface side of the inserting portion 11*a*. In a state where the liquid supply needle 21 is not inserted, the slit 12 is in a state where it is closed by its own inner stress. Projecting portions 11*g* and 11*h* are provided for parts of the periphery of the inserting portion 11*a* of the elastic member 11 as will be explained hereinafter, thereby assuring the reliability of the closing state of the slit.

The opening portion 14 has a concave shape of a circular cone in which the diameter d5 of the opening portion 14 is larger than the outer diameter d4 of the liquid supply needle 21, the diameter of the bottom surface 13 is smaller than the outer diameter d4 of the liquid supply needle 21, and the opening 14*a* and the bottom surface 13 are coupled via the inclined surface 11*f*.

The elastic member 11 is put onto the upper surface 11*d* of a supporting portion 15*a* provided for the casing 15 so that the lower surface 11*c*1 of the supporting fixing portion 11*c* is come into contact with the upper surface 11*d*. Further, the elastic member 11 is sandwiched between the casing 15 and the pressing plate 31 in such a manner that the elastic member 11 is crushed by a predetermined crush amount by applying a pressure by the pressing plate 31 from the upper surface 11*d* side of the supporting fixing portion 11*c*.

On the other hand, the gap 81 is also formed between the lower surface 11*e* of the inserting portion 11*a* and the bottom surface 15*b* of the casing 15, when the liquid supply needle 21 is inserted into the slit 12, the lower surface 11*e* of the inserting portion 11*a* is come into contact with the bottom surface 15*b* of the casing 15, the bottom surface 15*b* functions as a stop portion, and the inserting portion 11*a* is supported, so that unnecessary deformation is prevented.

The direction of a force to sandwich the portion 11*c*' of the supporting fixing portion 11*c* by the casing 15 and the pressing plate 31 is set to be almost the same as the direction in which the liquid supply needle 21 is inserted into the slit 12. Owing to such a construction, the inner stress which is generated by sandwiching the portion 11*c*' of the supporting fixing portion 11*c* is not applied in the clamping direction of the slit 12. Therefore, the inserting force to insert the liquid supply needle 21 becomes only the force to push and widen the slit 12 of the joint member 11. The inserting force is extremely smaller than the pressure which is applied in the clamping direction of the slit by inserting the joint member into the ordinary casing, so that the load on the driving system of the main body can be reduced. By using the construction in which the portion 11*c*' of the supporting fixing portion 11*c* is sandwiched, the joint member can be certainly pushed and attached to the casing 15 and the problem of the ink leakage from the joint portion can be also preferably solved.

The projecting portions 11*g* and 11*h* (11*h* is not shown) are provided for the elastic member 11. An external shape of the elastic member 11 in this example comprises: the projecting portions 11*g* at two positions in each of which a circle of ϕ2.2 and an arc of ϕ2.9 are formed with a width of 1 mm; and the projecting portions 11*h* at two positions in each of which an arc of ϕ2.7 is formed with a width of 1 mm. The slit 12 having a length of 0.3 mm is formed at the center of the elastic member 11. The projecting portions 11*g* at two positions in each of which the arc of ϕ2.9 is formed with a width of 1 mm are provided at positions which perpendicularly cross the notching direction of the slit 12. The projecting portions 11*h* at two positions in each of which the arc of ϕ2.7 is formed with a width of 1 mm are provided at extending positions of the notching direction of the slit 12. Since the elastic member 11 is attached to the housing 15 by the pressing plate 31 as mentioned above, as compared with the case of the construction in which the whole periphery of the elastic member 11 is fitted into the housing 15, a contracting force in the direction of the slit 12 which is generated does not need to contribute to the attachment of the elastic member 11 but it is sufficient that the contracting force functions with respect to a point that the ink leakage from the slit can be suppressed. Therefore, the inner stress of the elastic member 11 can be suppressed and an insertion load on the liquid supply tube 21 can be reduced, thereby enabling the liquid supply needle and a rubber cap to be connected in a small motor.

Since the projecting portions 11*g* and 11*h* which are pressed to the housing 15 in four directions of the elastic member 11 exist, the inserted elastic member is not inclined but can be precisely fitted into the housing 15. Thus, a variation in positional precision of the elastic member at the time of insertion of the liquid supply tube can be reduced, the insertion load at the time of connection to the liquid supply tube is reduced, and the problem that the elastic member is scraped by the liquid supply tube and that is caused due to a variation in positional precision can be prevented.

Further, the pressing plate 31 is constructed as a guide surface 31*a* in almost a funnel shape in which the portion corresponding to the opening 14 of the elastic member 11 contracts toward the inserting direction of the ink supply tube 21 and approaches the concave portion 11*f*.

In the embodiment, the inner diameter of the housing 15 is equal to ϕ2.6 mm and its material is Noryl. The pressing plate 31 is made of the material of SUS304, its thickness is equal to 0.3 mm, it has an opening window (ϕD1) of ϕ1.6 mm which the ink supply tube 21 pierces, and its minimum diameter is equal to ϕ0.6 mm.

An opening diameter (ϕD2) of the concave portion 11*f* of the elastic member is equal to ϕ2.0 mm, an external shape of the convex portion 11*a* is a cylindrical shape of ϕ2.2 mm, and a thickness of sandwiching portion is equal to 0.7 mm. Chlorinated butyl rubber is used as a material. Upon selection of this part, it is sufficient to use an arbitrary part which can endure the ink that is used and in which evaporation from a sealing portion is small. It is desirable to use the part in which the inserting force upon joining of the ink supply tube 21 is small. By setting the portion of the maximum width of the convex portion 11*a* of the elastic member to 2.85 mm as compared with the inner diameter ϕ2.6 mm of the housing 15 so as to set the elastic member into the clamping fitting state, an adhesion force of the slit 12 is raised and the ink sealing performance is improved. The portion of the maximum width is not provided for the whole periphery of the housing but provided only for the portion whose width is about twice as large as that of the slit 12 and whose height is equal to the thickness of slit 12. The inserting force of an ink supply barrel-shaped member 5 is increased by about 50 gf.

In the embodiment, a contact angle of the liquid supply tube 21 and the guide surface 31*a* is set to about 30° in consideration of miniaturization of the cartridge.

The stop portion 15*b* which restricts the elastic deformation of the elastic member 11 when the ink supply tube 21 penetrates the slit 12 of the elastic member 11 is provided for the housing 15 so as to face the convex portion 11*a*. An opening diameter of the stop portion 15*b* is equal to ϕ1.4 mm and a distance to a flat portion of the opposite convex portion 11*a* is equal to about 0.1 mm. In the embodiment, a stroke of penetration of the slit 12 of the elastic member 11 is confirmed in an environment of a low temperature 5° C. and a humidity 10% in which the insertion of the ink supply tube 21 is considered to be hard to the elastic member 11 whose adhesion performance of the slit 12 has been improved. Thus, the maximum stroke is equal to about 3.5 mm as compared with the standard (4.1 mm) of the apparatus and it has been confirmed that the penetration stroke does not lack.

According to the embodiment as mentioned above, while an outer diameter D of the convex portion 11*a* of the elastic member is set to ϕ2.2 mm, by setting an inner diameter D3 of the stop portion 15*b* to ϕ1.4 mm and setting a gap from the flat portion of the convex portion 11*a* to the stop portion 15*b* to 0.1 mm, even if the ink supply tube 21 is inserted, the extension of the elastic member 11 is suppressed by the stop portion 15*b* and repulsion of the elastic member 11 from the stop portion 15*b* can acts easily as a force in the direction for shearing the ink supply tube 21 and the ink supply tube 21 penetrates the slit 12.

As described above, according to the invention, the joint member enables the liquid supply needle to be inserted into the slit without being come into contact with the liquid supply needle at the surface which almost perpendicularly crosses the inserting direction of the liquid supply needle. Therefore, the scraping, cracks, or the like of the joint member which is caused when the joint member is coming into contact with the liquid supply needle at an almost right angle does not occur. Thus, the occurrence of the ink leakage from the joint member can be prevented and the reliability of the joining operation can be fairly improved.

What is claimed is:

1. An ink cartridge for use with a liquid discharge head having a liquid supply needle, the cartridge comprising:

a liquid tank adapted to enclose a liquid in a casing;

a pressing plate comprising a funnel-shape guide surface; and at least one elastic member sandwiched between the casing and the pressing plate, said elastic member being formed with a slit configured to permit communication between said liquid supply needle and the liquid tank, wherein said elastic member comprises a concave portion adapted to guide said liquid supply needle into said slit, and defining an opening portion and a bottom portion, the opening portion, seen in an inserting/pulling-out direction of said liquid supply needle into/from said slit, being larger than a needle projection shape as a projection shape of an exterior of said liquid supply needle seen in said inserting/pulling-out direction and the bottom portion being smaller than said needle projection shape, wherein said elastic member is fixed by a sandwiching force in a direction which is substantially parallel with a penetrating direction of said slit formed by penetrating said elastic member, wherein a portion of the guide surface corresponding to the opening portion contracts toward said inserting/pulling-out direction, and wherein a top end of the funnel-shape guide member of the pressing plate is not in contact with said elastic member, and there is a gap between a lower surface of said elastic member and a bottom surface of a housing.

2. A cartridge according to claim 1, wherein the direction of the sandwiching force is substantially the same as a direction in which said liquid supply needle is inserted into the slit.

3. A cartridge according to claim 1, wherein said slit comprises a slit-shaped through hole that defines a slit direction and a clamping direction perpendicular to the slit direction, and wherein inner stress generated by sandwiching the least one of said joint members is not applied in the clamping direction.

4. A cartridge according to claim 3, wherein a force to widen said slit equals an insertion force to insert said liquid supply needle.

5. A cartridge according to claim 1, wherein a contact angle of said guide surface to said liquid supply needle during insertion/pulling-out is set to about 30.

* * * * *